US011753272B2

(12) United States Patent
Morrison

(10) Patent No.: US 11,753,272 B2
(45) Date of Patent: Sep. 12, 2023

(54) MOBILE REEL CARRIER

(71) Applicant: Gary Morrison, South Point, OH (US)

(72) Inventor: Gary Morrison, South Point, OH (US)

( * ) Notice: Subject to any disclaimer, the term of this patent is extended or adjusted under 35 U.S.C. 154(b) by 186 days.

(21) Appl. No.: 17/117,221

(22) Filed: Dec. 10, 2020

(65) Prior Publication Data

US 2021/0171312 A1 Jun. 10, 2021

Related U.S. Application Data

(60) Provisional application No. 62/946,354, filed on Dec. 10, 2019.

(51) Int. Cl.
*B65H 75/40* (2006.01)
*B65H 75/44* (2006.01)

(52) U.S. Cl.
CPC ..... *B65H 75/403* (2013.01); *B65H 75/4407* (2013.01); *B65H 75/4471* (2013.01); *B65H 2701/33* (2013.01); *B65H 2701/533* (2013.01)

(58) Field of Classification Search
CPC ..... B65H 75/403; B65H 75/4407; B65H 75/4471; B65H 75/4486; B65H 2701/33; B65H 2701/533
See application file for complete search history.

(56) References Cited

U.S. PATENT DOCUMENTS 9,944,491 B2 * 4/2018 Guiffault ..... B65H 75/4471
2004/0021030 A1 * 2/2004 Bracking ..... B65H 75/4471 242/395
2004/0231723 A1 * 11/2004 Harrington ..... A01G 25/162 137/355.2
2019/0298984 A1 * 10/2019 Ethridge ..... A61M 39/08

* cited by examiner

*Primary Examiner* — Sang K Kim
(74) *Attorney, Agent, or Firm* — YORK LAW LLC; Olen L. York, III

(57) ABSTRACT

A reel carrier that includes a pallet having a platform bound by a frame and a shaft. The carrier includes a reel that is supported on the shaft. The reel includes a round drum rotatable about the shaft, wherein the rotation may be in a forward and/or a reverse or backward rotational direction. The carrier also includes a motor operably coupled to cause rotation of the drum and may be further operably coupled to cause deployment and/or retraction of one or more wheels included with the pallet, wherein the motor also controls locomotion of the one or more wheels.

20 Claims, 3 Drawing Sheets

MOBILE REEL CARRIER

I. RELATED APPLICATIONS

This application claims the benefit of U.S. Provisional Application No. 62/946,354, filed on Dec. 10, 2019.

II. FIELD OF THE INVENTION

This application discloses claims and embodiments a mobile reel carrier for on-loading and off-loading rolled product to and from a drum or spool containing rolled product(s).

III. BACKGROUND OF THE INVENTION

Many apparatuses, systems, and methods have been and are offered to address winding and/or dispensing rolled products, such as bare and/or insulated wire and/or cable. These apparatuses, systems, and methods include a non-exhaustive recitation of varied articles, such as reels having an intermediate spool disposed between end flanges, stationary reel racks, mobile reel caddies that are manually manipulated and positioned, reel elevation mechanisms for dispensing product, manually operated wire or cable metering devices, stationary and/or portable payout stands.

However, each category of dispenser identified above generally suffers from at least one drawback, such as the need for manually mounting the drum(s) or spool(s) and thereafter manually manipulating the device to achieve payout of the product. Such manual payout is complicated with the concern of navigating uneven and/or soft terrain. Because of the manual manipulation of these various options, one or more individuals are exposed to a variety of injury risks because of the weight, angle of positioning, terrain, and other related hazard-inducing concerns.

More particularly, wood reels are usually large and extremely heavy. Manual positioning of such wood reels, especially with rolled products (e.g., cable and/or wire) placed thereon, proves very difficult for one or more individuals. Individuals have difficulty moving such large reels, which can measure between several hundred pounds to nearly 15,000 pounds in extreme instances. Utilizing more than one individual to move such reels, despite improving the likelihood and relative ease of moving the reel, the addition of other individuals instead introduces increased likelihood of injury risk, and depending upon the dimension of the reel, may prove to be inefficient and equally as difficult without any improvement in moving the reel and doing so safely.

Accordingly, there is a need for an apparatus, system, and/or method that provides improved safety and injury risk-mitigation for individuals tasked with on-loading and/or off-loading rolled products from such drums or spools.

IV. SUMMARY OF THE INVENTION

In one embodiment, a reel carrier for a rolled product is described, the reel carrier comprising a pallet having a platform bound by a frame, the pallet having a shaft, a first sidewall upwardly depending from the frame and a second sidewall upwardly depending from the frame, the first sidewall and the second sidewall configured in mutual opposition and supporting the shaft therebetween, the shaft rotatable in a forward and reverse direction, the first sidewall and the second sidewall collapsible, a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product, and a motor operably coupled to cause rotation of the shaft supporting the reel.

The carrier further comprises a control panel operably coupled with the motor.

The carrier further comprises a plurality of wheels depending from the pallet. In one such embodiment, the motor is operably coupled to at least one of the plurality of wheels, the motor configured and adapted to cause rotation to the at least one of the plurality of wheels via steering means for providing locomotion to the carrier. In another such embodiment, the motor is operably coupled to the plurality of wheels, the motor configured and adapted to deploy and/or retract each one of the plurality of wheels within the frame of the pallet, wherein the motor is configured and adapted to deploy and/or retract each one of the plurality of wheels via wheel articulation means within the platform of the frame thereby concealing the plurality of wheels.

The carrier further comprises a canopy having a top panel, a front panel, and a rear panel, wherein the front panel and rear panel downwardly depend from the top panel, the front panel and rear panel configured and oriented in mutual opposition to one another, wherein the canopy complements the first sidewall and the second sidewall and defines an enclosure for the reel supported on the shaft between the first sidewall and the second sidewall.

The carrier further comprising means for elevating the shaft between a base position and an elevated position, wherein elevation means is configured and adapted for placement within the pallet.

In another embodiment, a reel carrier for a rolled product is described, the reel carrier comprising a pallet having a platform bound by a frame, the pallet having a shaft, a first sidewall upwardly depending from the frame and a second sidewall upwardly depending from the frame, the first sidewall and the second sidewall configured in mutual opposition and supporting the shaft therebetween, the shaft rotatable in a forward and reverse direction, the first sidewall and the second sidewall collapsible, a reel having a round drum, the reel and round drum supported on the shaft and rotatable about the shaft in a forward and a reverse direction, the reel and round drum configured to take-up the rolled product thereon to subsequently pay-off the rolled product from the top-side of the reel in an over-the-top delivery to optimize the structural integrity of the rolled product and minimize the structural stress of the rolled product, and a motor operably coupled to cause rotation of the shaft supporting the reel.

The carrier further comprises a control panel operably coupled with the motor, wherein the control panel is operably coupled with the motor to control take-up of the rolled product onto the reel and round drum and control pay-off of the rolled product from the reel and round drum. The control panel is operably coupled with the motor and comprises individual control for powering-on and powering-off of the motor, forward and reverse rotation of the reel and round drum supported on the shaft, vertical elevation and de-elevation of the shaft, variable rotational speed and breaking of the reel and round drum as supported on the shaft.

In one variation of this embodiment, the carrier further comprises a plurality of wheels depending from the pallet, wherein the motor is operably coupled to at least one of the plurality of wheels via steering means, the motor configured and adapted to cause rotation to the at least one of the plurality of wheels for providing locomotion to the carrier.

In another variation of this embodiment, the carrier further comprises a plurality of wheels depending from the pallet, wherein the motor is operably coupled to the plurality of wheels via wheel articulation means, the motor configured and adapted to deploy and/or retract each one of the plurality of wheels within the frame of the pallet. The motor is configured and adapted to deploy and/or retract each one of the plurality of wheels within the platform of the frame thereby concealing the plurality of wheels.

The carrier further comprises a control panel operably coupled with the motor, wherein the control panel is operably coupled with the motor to control take-up of the rolled product onto the reel and round drum and control pay-off of the rolled product from the reel and round drum, wherein the control panel is operably coupled with the motor and comprises individual control for powering-on and powering-off of the motor, forward and reverse rotation of the reel and round drum supported on the shaft, vertical elevation and de-elevation of the shaft, variable rotational speed and breaking of the reel and round drum as supported on the shaft, and the control panel operably coupled with the motor to deploy and retract each one of the plurality of wheels within the platform of the frame.

The carrier further comprises a canopy having a top panel, a front panel, and a rear panel, wherein the front panel and rear panel downwardly depend from the top panel, the front panel and rear panel configured and oriented in mutual opposition to one another, wherein the canopy complements the first sidewall and the second sidewall and defines an enclosure for the reel supported on the shaft between the first sidewall and the second sidewall.

The carrier further comprises means for elevating the shaft between a base position and an elevated position, wherein elevation means is configured and adapted for placement within the pallet.

In another aspect, a system for storing and transporting a rolled product is described, the system comprises a reel carrier for a rolled product. Consistent with the previous embodiment, the reel carrier at least comprises a pallet with a first sidewall and a second sidewall, a reel having a round drum supported on a shaft supported between the sidewalls and rotatable, and a motor operably coupled to cause rotation of the shaft supporting the reel.

More particularly, the reel carrier comprising the system described above comprises a pallet having a platform bound by a frame, the pallet having a shaft, a first sidewall upwardly depending from the frame and a second sidewall upwardly depending from the frame, the first sidewall and the second sidewall configured in mutual opposition and supporting the shaft therebetween, the shaft rotatable in a forward and reverse direction, the first sidewall and the second sidewall collapsible. The reel carrier comprises a reel having a round drum, the reel and round drum supported on the shaft and rotatable about the shaft in a forward and a reverse direction, the reel and round drum configured to take-up the rolled product thereon to subsequently pay-off the rolled product from the top-side of the reel in an over-the-top delivery to optimize the structural integrity of the rolled product and minimize the structural stress of the rolled product. The reel carrier also includes a motor operably coupled to cause rotation of the shaft supporting the reel. The reel carrier additionally includes a canopy having a top panel, a front panel, and a rear panel, wherein the front panel and rear panel downwardly depend from the top panel, the front panel and rear panel configured and oriented in mutual opposition to one another, wherein the canopy complements the first sidewall and the second sidewall and defines an enclosure for the reel supported on the shaft between the first sidewall and the second sidewall.

The system protects the rolled product on the reel and round drum via the canopy that is placed in complementary orientation to the first sidewall and the second sidewall, forming a complete protective shell enclosure over the rolled product, the canopy in combination with the first sidewall and the second sidewall forming the complete protective shell enclosure to minimize physical and/or structural damage that might otherwise happen to the rolled product during on-loading, transport, off-loading, and/or installation of the rolled product.

The system is controlled through automated command via the control panel to achieve locomotion of the reel carrier device and minimize physical damage to human laborers, and once the canopy is removed for take-up or pay-off of the rolled product, the control panel allows control of the location, proximity, and speed by which take-up and/or pay-off is achieved.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

Figure 4A:
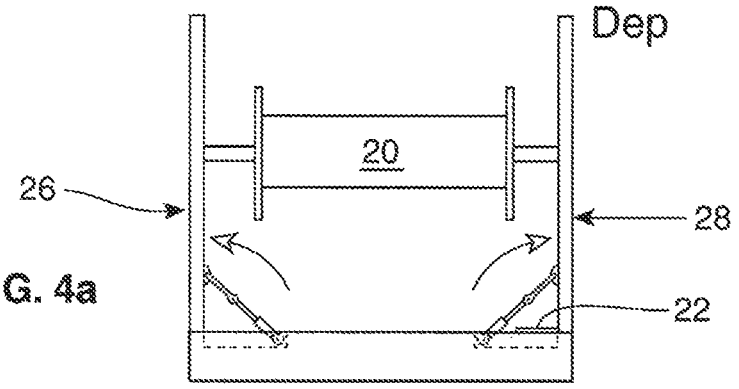
Figure 4B:
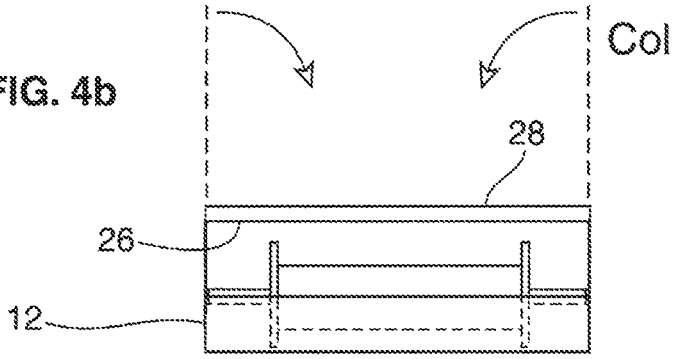

FIG. 4*a* is a front view of the pallet with the sidewalls deployed (Dep); and FIG. 4*b* is a front view of the pallet with the sidewalls collapsed (Col).

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
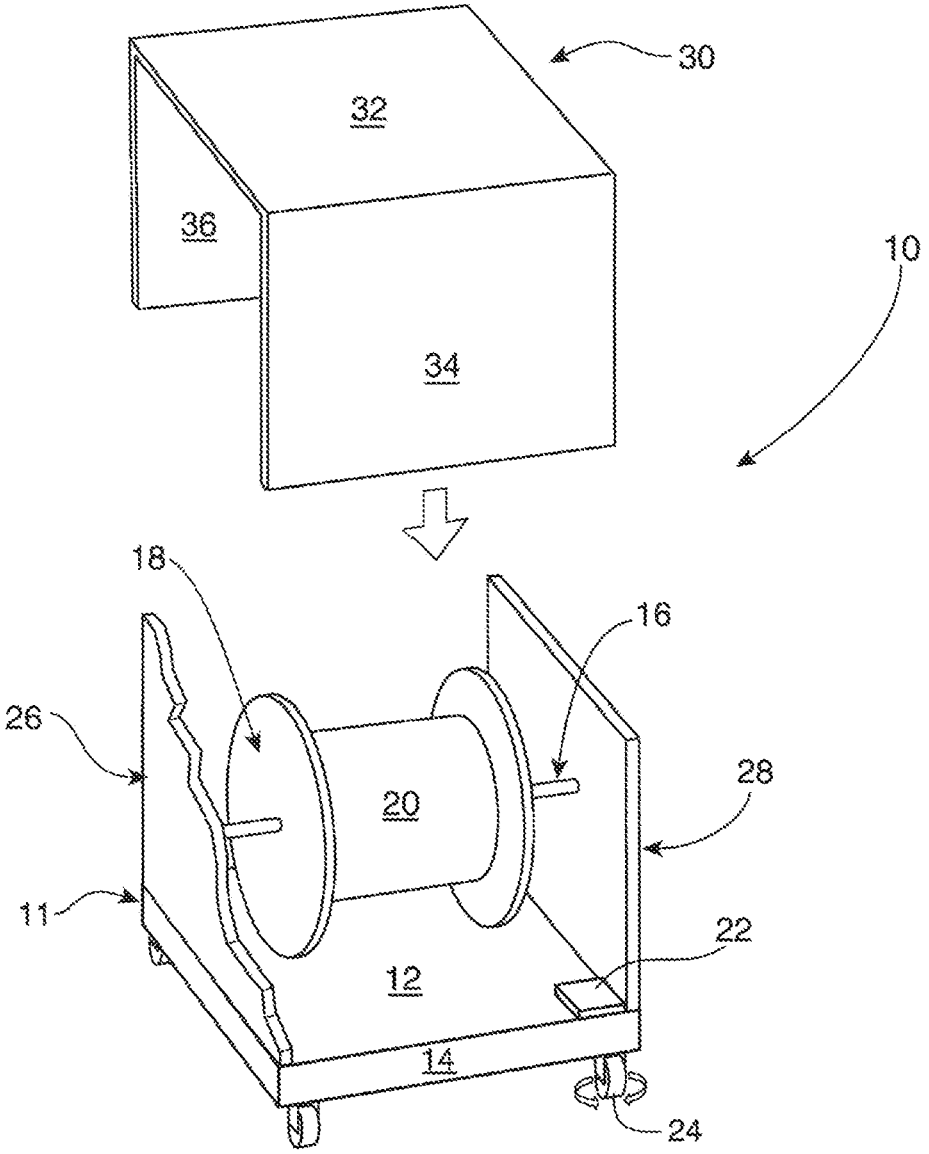
FIG. 1 is a perspective view of a reel carrier apparatus.

In accordance with the drawings illustrating at least one embodiment, as generally depicted in FIG. 1 through FIG.

4*a* and FIG. 4*b*, a reel carrier apparatus 10 comprises a pallet 11 having a platform 12 bound by a frame 14. The pallet 11 has a shaft 16 that supports a reel 18. The reel 18 has a round drum 20 rotatable about the shaft 16 in a forward and a backward direction. The carrier 10 also includes a motor 22 operably coupled to independently control forward or backward rotation of the shaft 16 or the drum 20, with the motor 22 capable of separate engagement of the shaft 16 and the drum 20 to effectuate take-up and/or pay-off, and with the motor 22 capable of concurrent, but separate engagement of the shaft 16 and drum 20. It is envisioned that the pallet 11 may further comprise a plurality of wheels 24 depending therefrom and providing the appropriate elevation of the pallet 11 relative to the surface(s) upon which the carrier 10 may travel. In one embodiment, the plurality of wheels 24 is retractable relative to a frame 14 of the pallet 11. In another embodiment, the plurality of wheels 24 is retractable within the frame 14 of the pallet 11. In another embodiment, the plurality of wheels 24 is retractable without the frame 14 of the pallet 11. In another embodiment, the plurality of wheels 24 is retractable as a combination within and without the frame 14 of the pallet 11.

The pallet 11 has a platform 12 that has an exterior surface and an interior surface, with a thickness defining the separation between the exterior surface and the interior surface. The pallet 11 includes a frame 14 bounding the perimeter of the exterior and interior surfaces defining the platform 12. In general, the pallet 11 has an orthogonal configuration, whether as a square or rectangular shape. However, it is further envisioned that the pallet 11 (and its constituent elements described herewith) may also have a disk, ovoid, or other polygonal shape. Regardless of pallet 11 shape, the pallet 11 and its constituent parts may be manufactured from a durable material, such as metal, alloys, plastic, or similarly durable materials, and combinations of these materials, and thereby avoiding utilization or over-reliance on resources difficult to renew (such as wood or wood-like products often used for both pallets and reels that are then-used for shipping and/or storage purposes).

It is envisioned that the reel 18 and/or drum 20, and in additional embodiments both the reel 18 and drum 20, may be configured so that the orientation of the reel 18 and/or drum 20 prevents take-up and pay-off from occurring in a manner that places distress on the rolled product. For example, it is envisioned that the reel 18 and/or drum 20 may be configured and oriented to inhibit the rolled product from paying-off via the underside of the reel 18 and/or drum 20, or from a counterclockwise rotation of the reel 18 and/or drum 20 when viewed from the right-side of the carrier 10 (with the sidewall 26 immediately adjacent this perspective) or from a clockwise rotation of the reel 18 and/or drum 20 when viewed from the left-side of the carrier 10 (with the sidewall 28 immediately adjacent this perspective). Paying-off rolled products from the underside of the reel, drum, or spool places tremendous physical strain and stress on the product and damages the product causing short-term inefficiencies and shortened life-span of the product, increasing costs for the end-user. By comparison, paying-off rolled products from the topside (over-the-top) of the reel, drum, or spool optimizes the structural integrity of the rolled product and minimizes the stress and strain placed on the rolled-product during delivery and installation.

The motor 22 may comprise a variety of configurations, including combinations of known components. For example, the motor 22 may be supplied energy via a standard fossil-fuel utilizing source (e.g., gasoline, diesel, and/or propane powered motors). In another example, the motor 22 may be supplied energy via electrical energy stored in some sufficient manner, whether by battery, capacitor, and/or utilization of electrical sources (including high-voltage electrical outlets).

Figure 2:
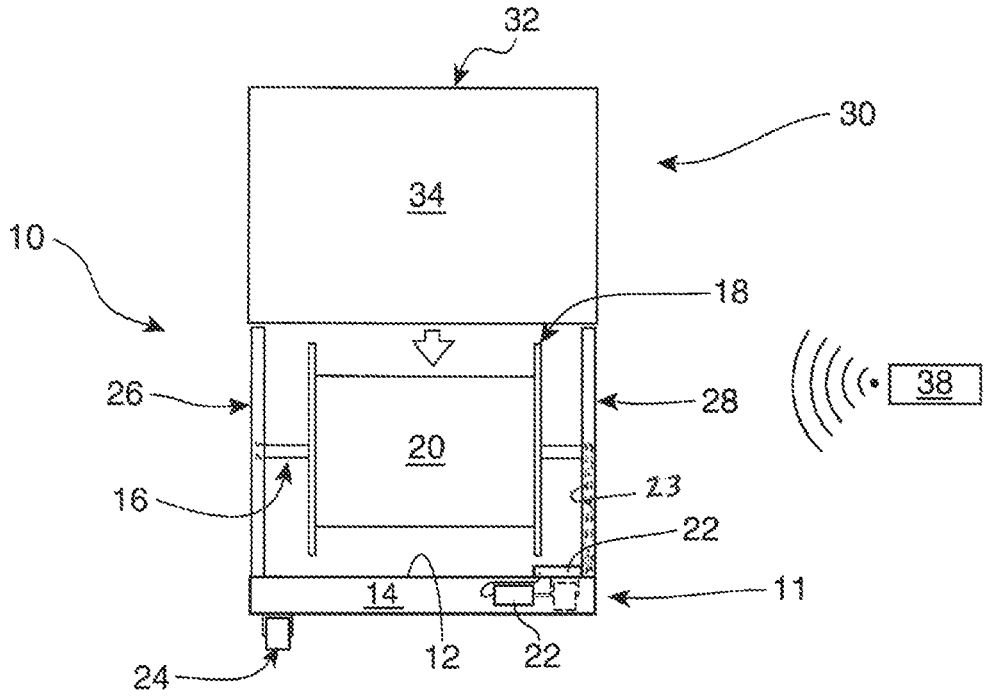
FIG. 2 is a front view of FIG. 1 with the wheels retracted.

The motor 22 is envisioned to control the forward and reverse rotational direction of the shaft 16, reel 16, and/or drum 20. This control may be achieved through a number of possible means, including motorized, automated rotation of the shaft 16, the reel 16, and/or the drum 20 (as depicted in FIG. 2 via drive or chain 23). Moreover, it is envisioned that the motor 22 controls the locomotion of the carrier 10 via one or more wheels 24, whereby the motor 22 automates and controls the direction of at least one wheel 24. It is further envisioned that the motor 22 may control at least two wheels 24, at least three wheels 24, at least four wheels 24, and includes the possibility of control all wheels 24 provided. Moreover, it is further envisioned that the motor 22 additional controls the direction of each wheel 24 during locomotion to move the carrier 10.

Various wheel articulation means may be utilized for deploying and retracting the plurality of wheels 24. For example, each wheel 24 may be configured to include a pivot with a locking mechanism to secure the wheel 24 in a deployed or retracted manner. Similarly, each wheel 24 may be configured to include a reciprocating post for deploying or retracting the wheel 24 between retracted and deployed positions. The wheels 24 may be deployed and retracted using manual or automated means, including manual manipulation of pivots and posts or automated manipulation utilizing hydraulic, pneumatic, mechanical, or other similar means, and/or combinations thereof. It is further envisioned that the motor 22 also controls the locomotion of the carrier 10 apparatus via steering means, wherein the motor 22 controls the deployment of one or more wheels 24 and the locomotion of the wheels 24 and the carrier 10 supported thereby.

It is envisioned that the pallet 11 may further comprise a first sidewall 26 and a second sidewall 28, each one of the sidewalls 26, 28 upwardly depending from the frame 14 of the pallet 11. In one embodiment, the first sidewall 26 and the second sidewall 28 are oriented in parallel to the general rotational direction of rotation of the drum 20 and are thereby oriented in parallel to one another (26 and 28). In such an orientation, therefore, the first sidewall 26 and the second sidewall 28 are mutually opposed to one another in substantially similar orientations. In another embodiment, the first sidewall 26 and the second sidewall 28 are oriented in a non-parallel orientation to one another (26 and 28), such that the sidewalls 26, 28 may be independently angled relative to shaft 16, reel 18, and drum 20, as well as the pallet 11 and platform 12 thereon. In such orientations it is desirable that the support of and insertion with and/or through of the shaft 16 is such that alignment and balance of the shaft 16 traverses the sidewalls 26, 28 at tangential points along each that are substantially in mutual opposition with one another (26, 28).

Consistent with FIG. 4*a* and FIG. 4*b*, it is further envisioned that the sidewalls 26, 28 of pallet 11 are separately capable of positioning between a collapsed and deployed or retracted position, as indicated by directional arrows (Col to Dep) relative to the platform 12. Securing each sidewall 26, 28 in a collapsed and/or retracted or deployed position may be achieved by a number of adjustment means, such as first adjustment means for first sidewall 26 and a second adjustment means for second sidewall 28 consistent with FIG. 4*a*. Adjustment means may include removable pins, snap-fit impingement, one or more hinges, channels, and the like.

The flexible, multiple positioning of the sidewalls 26, 28 imparts additional capability by allowing the user/operator to conveniently store and/or stack one or more carriers 10 in a manner that optimizes transports of one or more carriers 10 to minimize movement and damage to the carrier 10, dead or under-utilized space within a transport, and other similar considerations.

The sidewalls 26, 28 include the shaft 16 that is intermediately disposed between the sidewalls 26, 28, with the shaft 16 so disposed to support the reel 18 (and drum 20) for rotation thereabout. The orientation of the sidewalls 26, 28 provides access via the front, top, and rear of the carrier 10. This access also accommodates a canopy 30 of complementary shape so that when the canopy 30 is placed into position, the canopy 30 and the sidewalls 26, 28 form an enclosure about the reel 18 and the components related thereto. Thus, the carrier 10 further comprises a canopy 30 having a top panel 32, a front panel 34, and a rear panel 36, wherein the front panel 34 and the rear panel 36 downwardly depend from the top panel 32, the canopy 30 complementing the first sidewall 26 and the second sidewall 28 and defining an enclosure for the reel 18 and related components. It is envisioned that the canopy 30 may be hinged or otherwise attached to the pallet 11 via platform 12. Moreover, it is also envisioned that the canopy 30 may be controlled by the control panel 38 via motor 22 (consistent with the disclosures herewith) to fully automate the opening and closing of the canopy 30 in cooperation with the remainder of the carrier 10 apparatus described herein.

Likewise, the other constituent parts or components of the carrier 10, including first sidewall 26 and second sidewall 28, the canopy 30 (and its components, top panel 32, front panel 34, and rear panel 36) may be manufactured from similarly durable materials, such as metal, alloys, plastic, and the like, and combinations of these materials.

The carrier 10 may also include a control panel 38. It is envisioned that the control panel 38 may include a variety of controls, including power (on/off); forward and backward rotation, including variable speed rotation; elevation and return; braking; and other associated controls for controlling the carrier 10 apparatus. It is envisioned that the control panel 38 is operably coupled with the motor 22 for specifically controlling on-loading (e.g., take-up) and off-loading (e.g., pay-off) of rolled product onto and/or from a reel 18 and/or drum 20 housed within the carrier 10, as well as controlling the locomotion and/or direction of one or more wheels 24 consistent with the disclosure provided above. It is further envisioned that the control panel 38 may also control the collapsible and/or deployable positioning of the sidewalls 26, 28 relative to the pallet 11 for storage and/or deployment as necessitated.

Figure 3:
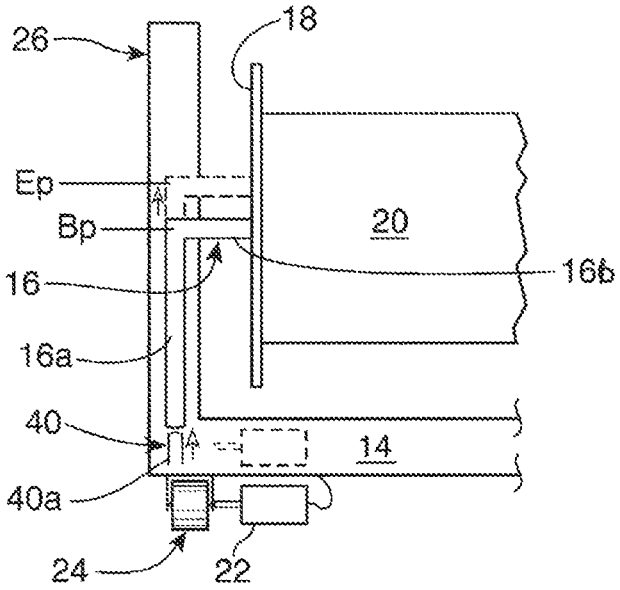
FIG. 3 is an exploded sectional view of a sidewall with elevation means.

More particularly, as related to elevation and return controls, it is envisioned that the carrier 10 may include elevation means 40 disposed within the pallet 11. Elevation means 40 supports the shaft 16 and is adjustable between a base position Bp and an elevated position Ep. As depicted in FIG. 3, it is envisioned that elevation means 40 may comprise a variety of components and/or elements, including as shown a piston or linkage 40*a* for advancing and urging the shaft post 16*a* from a base or starting position (Bp) to an elevated position (Ep) and then returned to the base or starting position (Bp) when the piston or linkage advance is removed and/or returned to a non-advanced/retracted position. By urging the shaft post 16*a*, the shaft arm 16*b* is also urged from a base or starting position (Bp) to an elevated position (Ep) and returned when removed or reversed.

The features described herewith provide several advantages not previously disclosed or known with rolled product take-up, transport, and pay-off apparatus(es) and/or system(s). For example, a carrier consistent with the description herewith is not known to have an automated take-up and pay-off mechanism in conjunction with an automated locomotion control mechanism, especially controlled by a motor that responds to a control or control panel input. Moreover, an apparatus or system is not known that includes a protective canopy to minimize and/or inhibit damage to the rolled product during on-loading, transport, off-loading, and installation preparation. Furthermore, an apparatus or system is not known that includes a multi-position sidewall and/or sidewalls that may be deployed and/or collapsed for storage.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A reel carrier for a rolled product, the reel carrier comprising:

a pallet having a platform bound by a frame, the pallet having a shaft, a first sidewall upwardly depending from the frame and a second sidewall upwardly depending from the frame, the first sidewall and the second sidewall configured in mutual opposition and supporting the shaft therebetween, the shaft rotatable in a forward and reverse direction, the first sidewall adjustable between a collapsed and deployed orientation via first adjustment means and the second sidewall adjustable between a collapsed and deployed orientation via second adjustment means;

a reel supported on the shaft and rotatable about the shaft in a forward and a reverse direction, the reel configured to take-up the rolled product thereon to subsequently pay-off the rolled product from the top-side of the reel in an over-the-top delivery to optimize the structural integrity of the rolled product and minimize the structural stress of the rolled product; and a motor operably coupled to cause rotation of the shaft supporting the reel.

2. The carrier of claim 1 further comprising a control panel operably coupled with the motor.

3. The carrier of claim 1 further comprising a plurality of wheels depending from the pallet.

4. The carrier of claim 3, wherein the motor is operably coupled to at least one of the plurality of wheels, the motor configured and adapted to cause rotation to the at least one of the plurality of wheels for providing locomotion to the carrier.

5. The carrier of claim 3, wherein the motor is operably coupled to the plurality of wheels via wheel articulation means, the motor configured and adapted to deploy and/or retract each one of the plurality of wheels within the frame of the pallet.

6. The carrier of claim 5, wherein the motor is configured and adapted via wheel articulation means to deploy and/or retract each one of the plurality of wheels within the platform of the frame thereby concealing the plurality of wheels.

7. The carrier of claim 1 further comprising a canopy having a top panel, a front panel, and a rear panel, wherein the front panel and rear panel downwardly depend from the top panel, the front panel and rear panel configured and oriented in mutual opposition to one another, wherein the canopy complements the first sidewall and the second sidewall and defines an enclosure for the reel supported on the shaft between the first sidewall and the second sidewall.

8. The carrier of claim 1 further comprising means for elevating the shaft between a base position and an elevated position, wherein elevation means is configured and adapted for placement within the pallet.

9. A reel carrier for a rolled product, the reel carrier comprising:

a pallet having a platform bound by a frame, the pallet having a shaft, a first sidewall upwardly depending from the frame and a second sidewall upwardly depending from the frame, the first sidewall and the second sidewall configured in mutual opposition and supporting the shaft therebetween, the shaft rotatable in a forward and reverse direction, the first sidewall adjustable between a collapsed and deployed orientation via first adjustment means and the second sidewall adjustable between a collapsed and deployed orientation via second adjustment means;

a reel having a round drum, the reel and round drum supported on the shaft and rotatable about the shaft in a forward and a reverse direction, the reel and round drum configured to take-up the rolled product thereon to subsequently pay-off the rolled product from the top-side of the reel in an over-the-top delivery to optimize the structural integrity of the rolled product and minimize the structural stress of the rolled product; and a motor operably coupled to cause rotation of the shaft supporting the reel.

10. The carrier of claim 9 further comprising a control panel operably coupled with the motor, wherein the control panel is operably coupled with the motor to control take-up of the rolled product onto the reel and round drum and control pay-off of the rolled product from the reel and round drum.

11. The carrier of claim 10, wherein the control panel is operably coupled with the motor and comprises individual control for powering-on and powering-off of the motor, forward and reverse rotation of the reel and round drum supported on the shaft, vertical elevation and de-elevation of the shaft, variable rotational speed and breaking of the reel and round drum as supported on the shaft.

12. The carrier of claim 9 further comprising a plurality of wheels depending from the pallet.

13. The carrier of claim 12, wherein the motor is operably coupled via steering means to at least one of the plurality of wheels, the motor configured and adapted to cause rotation to the at least one of the plurality of wheels for providing locomotion to the carrier.

14. The carrier of claim 12, wherein the motor is operably coupled to the plurality of wheels via wheel articulation means, the motor configured and adapted to deploy and/or retract each one of the plurality of wheels within the frame of the pallet.

15. The carrier of claim 14, wherein the motor is configured and adapted via wheel articulation means to deploy and/or retract each one of the plurality of wheels within the platform of the frame thereby concealing the plurality of wheels.

16. The carrier of claim 9 further comprising a control panel operably coupled with the motor.

17. The carrier of claim 16, wherein the control panel is operably coupled with the motor to control take-up of the rolled product onto the reel and round drum and control pay-off of the rolled product from the reel and round drum, wherein the control panel is operably coupled with the motor and comprises individual control for powering-on and powering-off of the motor, forward and reverse rotation of the reel and round drum supported on the shaft, vertical elevation and de-elevation of the shaft, variable rotational speed and breaking of the reel and round drum as supported on the shaft, and the control panel operably coupled with the motor to deploy and retract each one of the plurality of wheels within the platform of the frame.

18. The carrier of claim 9 further comprising a canopy having a top panel, a front panel, and a rear panel, wherein the front panel and rear panel downwardly depend from the top panel, the front panel and rear panel configured and oriented in mutual opposition to one another, wherein the canopy complements the first sidewall and the second sidewall and defines an enclosure for the reel supported on the shaft between the first sidewall and the second sidewall.

19. The carrier of claim 9 further comprising means for elevating the shaft between a base position and an elevated position, wherein elevation means is configured and adapted for placement within the pallet.

20. A system for storing and transporting a rolled product, the system comprising:

a reel carrier for a rolled product, the reel carrier comprising:

a pallet having a platform bound by a frame, the pallet having a shaft, a first sidewall upwardly depending from the frame and a second sidewall upwardly depending from the frame, the first sidewall and the second sidewall configured in mutual opposition and supporting the shaft therebetween, the shaft rotatable in a forward and reverse direction, the first sidewall adjustable between a collapsed and deployed orientation via first adjustment means and the second sidewall adjustable between a collapsed and deployed orientation via second adjustment means;

a reel having a round drum, the reel and round drum supported on the shaft and rotatable about the shaft in a forward and a reverse direction, the reel and round drum configured to take-up the rolled product thereon to subsequently pay-off the rolled product from the top-side of the reel in an over-the-top delivery to optimize the structural integrity of the rolled product and minimize the structural stress of the rolled product;

a motor operably coupled to cause rotation of the shaft supporting the reel;

a canopy having a top panel, a front panel, and a rear panel, wherein the front panel and rear panel downwardly depend from the top panel, the front panel and rear panel configured and oriented in mutual opposition to one another, wherein the canopy complements the first sidewall and the second sidewall and defines an enclosure for the reel supported on the shaft between the first sidewall and the second sidewall;

wherein the system protects the rolled product on the reel and round drum via the canopy that is placed in complementary orientation to the first sidewall and the second sidewall, forming a complete protective shell enclosure over the rolled product, the canopy in combination with the first sidewall and the second sidewall forming the complete protective shell enclosure to minimize physical and/or structural damage that might otherwise happen to the rolled product during on-loading, transport, off-loading, and/or installation of the rolled product;

wherein the system is controlled through automated command via the control panel to achieve locomotion of the reel carrier device and minimize physical damage to human laborers, and once the canopy is removed for take-up or pay-off of the rolled product, the control panel allows control of the location, proximity, and speed by which take-up and/or pay-off is achieved.

* * * * *